United States Patent [19]

Troesch et al.

[11] 3,954,602

[45] May 4, 1976

[54] PROCESS FOR CLEANING USED OILS

[75] Inventors: André Troesch, Paris; Fernand Cleron, Chelles, both of France

[73] Assignee: Societe Parisienne des Lubrifiants Nationaux et des Entrepots d'Hydrocarbures, Aubervilliers, France

[22] Filed: Feb. 20, 1974

[21] Appl. No.: 444,549

[30] Foreign Application Priority Data

Mar. 1, 1973 France ..... 73.07275

[52] U.S. Cl. ..... 208/179; 208/183

[51] Int. Cl.[2] ..... C10M 11/00

[58] Field of Search ..... 208/179, 180, 182, 183, 208/186

[56] References Cited

UNITED STATES PATENTS 1,976,177 10/1934 Lazar ..... 208/183

FOREIGN PATENTS OR APPLICATIONS 1,215,422 12/1970 United Kingdom ..... 208/186

413,537 7/1934 United Kingdom ..... 208/186

*Primary Examiner*—Delbert E. Gantz
*Assistant Examiner*—G. J. Crasanakis
*Attorney, Agent, or Firm*—Wenderoth, Lind & Ponack

[57] ABSTRACT

A process for cleaning a used oil, in particular engine oil and industrial lubricating oil. The process comprises heat treating the used oil in a heat treatment zone at a temperature of 325°–400°C at a pressure of 1–6 bars for a period of at least 15 minutes, continuously withdrawing a first part of the treated oil from the heat treatment zone, re-heating said first part of the oil and recycling the re-heated first part of the oil through the heat treatment zone, subjecting the remainder of the heat treated oil from the heat treatment zone to a treatment for separating out the sedimentary residues from the heat treated oil. The sedimentary residues are incinerated in the re-heating furnace for re-heating said first part. A system is described for carrying out the process.

6 Claims, 1 Drawing Figure

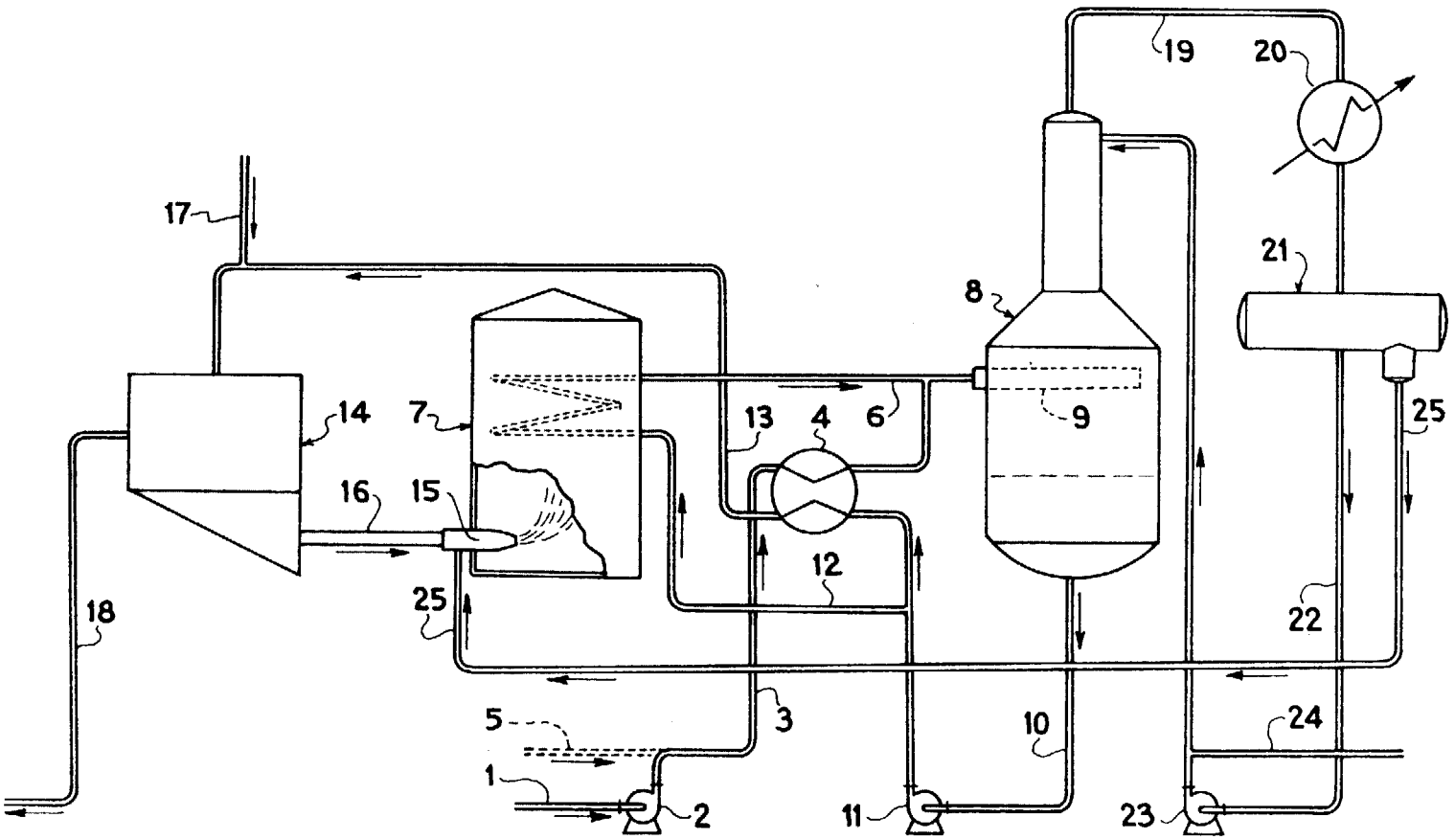
1
2
3
4
5
6
7
8
9
10
11
12
13
14
15
16
17
18
19
20
21
22
23
24
25
25

PROCESS FOR CLEANING USED OILS

BACKGROUND OF THE INVENTION

The present invention relates to a process for cleaning used oils, in particular engine lubricating oils and oils used in industry and to an apparatus for carrying out said process.

Processes for cleaning used oils have been described which treat the oils with heat and/or with various chemical agents, but none of these processes gives satisfaction when it is desired to obtain a sediment-free oil, that is, oil from which sediments have been entirely removed which is appropriate for the subsequent treatments such as a low-residue distillation.

Moreover, the known processes give rise to delicate problems as concerns the discharge of the waste and residues which constitute a source of pollution which must be absolutely avoided.

SUMMARY OF THE INVENTION

An object of the present invention is to overcome these drawbacks of the prior processes.

An object of the invention is to provide a process and an apparatus for cleaning used oils which give cleaned oils from which their sediments have been perfectly removed which are absolutely appropriate for a subsequent treatment, such as refining or distillation including a low-residue distillation. Further, the process according to the invention presents no pollution problem.

The invention provides a process for cleaning a used oil comprising subjecting the used oil to a heat treatment at a temperature of 325°–400°C under a pressure of 1–6 bars for a period of at least 15 minutes, a part of the oil being withdrawn continuously from the treating zone and recycled in the latter after re-heating; separating the sedimentary residues of the treated oil leaving the heat treatment zone and employing said residues for re-heating the recycled oil.

According to another feature of the invention, the residues are separated out by filtration of the treated oil on filtration adjuvants, in particular products of cellulose origin, the filtration cake obtained being employed for the re-heating of the recycled oil.

Another object of the invention is to provide an apparatus for carrying out said process comprising a reactor for treating the oil; a furnace for re-heating the recycled oil connected to said reactor, said furnace having means for incinerating the sedimentary residues of the treated oil and the other polluting waste products of the treatment; and a device for separating out the sedimentary residues.

According to one embodiment, the device for separating the sedimentary residues is a filtration apparatus.

According to another embodiment, the separating device is a centrifugation apparatus.

BRIEF DESCRIPTION OF THE DRAWINGS

Further features and advantages of the invention will be apparent from the ensuing description with reference to the accompanying drawing.

In the drawing, the single FIGURE shows diagrammatically an apparatus for carrying out the process according to the invention.

DETAILED DESCRIPTION OF THE INVENTION

With reference to the drawing, the used oil to be treated, which may be for example an engine oil or a lubricating oil employed in industry and may contain the usual conventional additives, is introduced by way of a conduit 1 and conveyed by a pump 2 to a conduit 3 in which is located a heat exchanger 4. Provided in the conduit 3 is an optional inlet conduit or device 5 by way of which may be introduced into the oil, if desired, auxiliary reactants or agents, for example sodium hydroxide or lime (up to about 3% by weight of the oil) mineral or organic acids (up to 2% by weight of the oil), salts such as zinc chloride and stannic chloride, oxidizers, surface-active agents etc.

The addition of such agents is not essential to the good operation of the process according to the invention but in the case of oils of particular compositions it may be of utility to facilitate the removal of sediments.

In the exchanger 4, the oil to be treated is heated to the extreme temperature of the partial vaporization of the water by heat exchange with the treated oil leaving the reaction zone.

After passage into the exchanger 4, the oil enters a conduit 6 which leads from a re-heating furnace 7 and where the oil is mixed with the oil recycled from the reaction zone, as will be explained in more detail hereinafter.

The mixture of oil to be treated and the recycled oil from the conduit 6 is conveyed into a reactor 8 through a distributor head 9.

In the reactor 8, the oil is treated at a temperature of about 325°–400°C and preferably 350°–380°C under a pressure of 1–6 bars and preferably 2–5 bars.

The oil must remain in the reactor 8 for a total period of at least 15 minutes and advantageously 15–30 minutes.

In certain cases, a total stay exceeding 30 minutes may be necessary.

The oil contained in the reactor 8 is drawn off by way of a conduit 10 by means of a pump 11 and it is divided into two parts.

One part is conveyed by way of a conduit 12 to the re-heating furnace 7 for its re-cycling in the reactor 8 and the other part is conveyed as treated oil by way of a conduit 13 to the exchanger 4 and thence to a sediment-separating apparatus 14.

The re-cycling rate is calculated in such manner as to ensure a sufficient stay in the reactor 8. It is usually between 5 and 20 and preferably between 8 and 12. If A is the amount of oil to be treated entering the apparatus by way of the conduit 1 and B the amount of oil flowing in the conduit 12, there is obtained:

$5A < B < 20A$, preferably $8A < B < 12A$.

The re-heating furnace 7, whose purpose is to return the recycled oil to the temperature of treatment in the reactor 8, is equipped with a burner whereby the sedimentary residues from the separating apparatus 14 are burnt, as shown diagrammatically at 16. For this purpose, the residues are, for example, emulsified by means of an aqueous effluent flowing from the reactor 8 by way of a conduit 25. The recovery of this aqueous effluent will be explained later.

A temperature of the order of 1000°C is reached in the furnace 7 and this enables all the pollutants contained in the sedimentary residues and in the aqueous effluent to be completely destroyed with no unburnt matter.

The separating apparatus 14 may be a centrifugation or a filtration apparatus, a filtration apparatus being preferred.

The filtration (or centrifugation) is carried out advantageously by employing as filtration adjuvants cellulose substances, for example wood dust or other suitable plant waste products which are introduced at 17. In this case, it is the filter cake comprising the filtration adjuvant and the sedimentary residues of the treated oil which is supplied to the re-heating furnace.

The filtration is preferably carried out at a temperature of 40°–160°C.

The oil from which the residues have been removed leaves the separation apparatus 14 by way of the conduit 18 and is ready for any possible subsequent treatment.

Referring now to the reactor 8, the light fractions of the oils leave the reactor by way of a conduit 19 and, after having been condensed in a condenser 20, they are decanted in a decanter 21 into an aqueous effluent and a light oil fraction which is conveyed by way of a conduit 22 and a pump 23 as reflux in the upper part of the reactor. A part of this oil is drawn off from the apparatus by way of a conduit 24. The reflux at the head of the reactor is regulated in such manner that a certain amount of light oils remain in the treated oil, since the presence of the light oils facilitates the subsequent operation for separating the residues.

The aqueous effluent is drawn off from the decanter 21 by way of the conduit 25 which conveys it to the burner 15 of the furnace 7.

With the process according to the invention, the sediments are perfectly removed from the used oils by destruction and degradation of the additives they contain, whereby it is possible to obtain a cleaned oil which has, even after having been left for long periods, neither specification of the "central part" nor "halo" with the spot test, as described in particular in the work "Les huiles pour moteurs et le graissage des moteurs" by A. Schilling, Vol. I, pages 89–91, and Vol. II, pages 332–334 published by the Institut Français du Pétrole, 1962.

This cleaned oil is perfectly adapted to any possible conventional subsequent treatments, such as refining or distillation and in particular a low-residue distillation which was economically inapplicable with prior oil-cleaning processes.

Further, the process according to the invention is a clean process, since all of the residues of the process (sedimentary residues, aqueous effluents resulting from the treatment etc.) are incinerated in the re-heating furnace 7 and converted into heat energy and into non-polluting products: fully mineralized cinders and gases of combustion.

The non-limitative examples, the results of which are given in the following Table I, are given solely by way of illustration of the invention. In this table, the oils and various products are referred to with respect to the conduits or apparatus shown in the FIGURE from where they are taken.

TABLE I

| No. of the test | | 1 | | 2 | | 3 | | 4 | |
|---|---|---|---|---|---|---|---|---|---|
| CONDITIONS OF TREATMENT IN THE REACTOR 8 | | | | | | | | | |
| Temperature | °C | 325 | | 350 | | 350 | | 375 | |
| Pressure | bars | 4 | | 2 | | 4 | | 1 | |
| Treating time | (minutes) | 30 | | 25 | | 15 | | 20 | |
| YIELDS | | | | | | | | | |
| Used oil (1) | | 100 | | 100 | | 100 | | 100 | |
| Treated oil (18) | | 88.7% | | 89.0% | | 85.0% | | 87.8% | |
| Light distillates (24) | | 1.8% | | 2.9% | | 3.0% | | 2.8% | |
| Aqueous liquid (25) | | 4.0% | | 2.7% | | 6.0% | | 4.1% | |
| Sedimentary residues | | 5.1% | | 4.9% | | 5.7% | | 4.8% | |
| Losses | | 0.4% | | 0.5% | | 0.3% | | 0.5% | |
| | | Oil (1) | Oil (18) | Oil (1) | Oil (18) | Oil (1) | Oil (18) | Oil (1) | Oil (18) |
| CHARACTERISTICS | | | | | | | | | |
| Density at 15°C | | 0.900 | 0.884 | 0.898 | 0.887 | 0.902 | 0.885 | 0.897 | 0.885 |
| Kinematic viscosity (centistokes) at 50°C | | 38.7 | 33.5 | 49.4 | 45.9 | 42.5 | 36.10 | 45.5 | 35.0 |
| Acid index | | 0.85 | 0.70 | 0.90 | 0.72 | 0.78 | 0.65 | 0.90 | 0.75 |
| Cinders | | 1.15% | 0.12% | 1.25% | 0.17% | 0.93% | 0.22% | 1.09% | 0.19% |
| Inflammability | | 135°C | 157°C | 125°C | 160°C | 110°C | 164°C | 134°C | °C |

All the used oils treated by the process described hereinbefore give neither a central spot, nor halo when subjected to the spot test.

The examples 1 to 4 fully satisfy this criterion.

Having now described our invention what we claim as new and desire to secure by Letters Patent is:

1. A process for cleaning used engine oils and industrial lubricating oils, comprising, (a) heat treating the used oil in a heat treatment zone at a temperature of 352°–400°C at a pressure of 1–6 bars for a period of at least 15 minutes, continuously withdrawing treated oil from said heat treatment zone, (b) re-heating a first portion of said treated oil to the treatment temperature and recycling the re-heated first portion of said treated oil to said heat treatment zone at a re-cycling rate in the range of 5 to 20, (c) separating the sedimentary residues from a second portion of said heat treated oil and (d) burning said residues from step (c) for re-heating said first portion of said treated oil in step (b).

2. A process as claimed in claim 1, wherein the separation of said residues is carried out by passing said second portion of said treated oil through a cellulosic filtration adjuvant, the mixture of said residues and said filtration adjuvant being burned in step (d).

3. A process as claimed in claim 1, wherein the separation of the residues is carried out by centrifugation.

4. A process as claimed in claim 1, wherein the heat treatment temperature is between 350° and 380°C, said pressure is between 2 and 5 bars and the total time of stay of the oil in the treatment zone is 15–30 minutes.

5. A process as claimed in claim 1, further comprising collecting from said heat treatment zone a light fraction which distills, separating said fraction into a light oil fraction, which is returned at least partly to said heat treatment zone, and an aqueous effluent fraction and mixing said aqueous effluent fraction with the sedimentary residues for said burning in step (d).

6. A process for cleaning used engine oils and industrial lubricating oils, comprising (a) heat treating the used oil in a heat treatment zone at a temperature of 325°–400°C at a pressure of 1–6 bars for a period of at least 15 minutes, continuously withdrawing a first portion of the heat treated oil from the heat treatment zone, (b) re-heating said first portion of the oil to said treatment temperature and recycling the re-heated first portion of the oil through said heat treatment zone at a re-cycling rate in the range of 5 to 20, (c) separating the sedimentary residues from a second portion of the heat treated oil by passing said second portion of said treated oil through wood dust and (d) burning the mixture of said residues and said wood dust from step (c) for re-heating said first portion of said treated oil in step (b).

* * * * *